US007270312B1

(12) United States Patent
Phipps

(10) Patent No.: US 7,270,312 B1
(45) Date of Patent: Sep. 18, 2007

(54) MULTIFUNCTIONAL WINCH DRUM DRIVE SYSTEM

(75) Inventor: Jeffery S. Phipps, Tallahassee, FL (US)

(73) Assignee: Growth Innovation, LLC, Tallahassee, FL (US)

( * ) Notice: Subject to any disclaimer, the term of this patent is extended or adjusted under 35 U.S.C. 154(b) by 0 days.

(21) Appl. No.: 11/520,960

(22) Filed: Sep. 14, 2006

(51) Int. Cl.
*B66D 1/22* (2006.01)

(52) U.S. Cl. ..... 254/297; 254/278

(58) Field of Classification Search ..... 254/294, 254/295, 296, 297, 298, 278
See application file for complete search history.

(56) References Cited

U.S. PATENT DOCUMENTS

| | | | | | |
|---|---|---|---|---|---|
| 2,548,270 | A | * | 4/1951 | Osgood | 254/297 |
| 2,696,366 | A | * | 12/1954 | Eskew | 254/298 |
| 3,405,878 | A | * | 10/1968 | Lawrence | 254/297 |
| 3,936,033 | A | * | 2/1976 | McElroy | 254/297 |
| 4,033,553 | A | * | 7/1977 | Sugimoto | 254/297 |
| 4,058,295 | A | * | 11/1977 | Morfitt | 254/291 |
| 4,065,101 | A | * | 12/1977 | Korkut | 254/295 |
| 4,915,320 | A | | 4/1990 | Neal | |
| 5,071,085 | A | | 12/1991 | Beers | |
| 5,277,350 | A | | 1/1994 | Thornbury, Jr. | |
| 5,906,325 | A | * | 5/1999 | Harrison, Jr. | 242/364.11 |
| 5,931,416 | A | | 8/1999 | Carpenter | |
| 6,286,786 | B1 | | 9/2001 | LeGette et al. | |
| 6,866,230 | B2 | | 3/2005 | Kucmerowski | |
| 6,877,697 | B2 | | 4/2005 | Bellacera | |

* cited by examiner

*Primary Examiner*—Emmanuel M Marcelo
(74) *Attorney, Agent, or Firm*—John Wiley Horton

(57) ABSTRACT

A winch drum drive system for controlling a kite. The winch drum drive system includes spools for winding an unwinding kite control lines and a set of planetary gears rotatably attached to one end of each of the spools. A ring gear wraps around each set of planetary gears so that the internal perimeter of the ring gear is meshed with each of the planetary gears in the set. The ring gear includes a set of external teeth so that it may be meshed with a second ring gear corresponding to a different spool. A ring drive gear is meshed with one of the ring gears, so that when power is sent to the ring drive gear the ring gears rotate in different directions. A sun gear is positioned between and meshed with each set of planetary gears. A sun drive gear is placed between and meshed with the sun gears so that when power is sent to the sun drive gear, the sun gears rotate in the same direction. Using the proposed configuration, powering the ring drive gear causes the spools to rotate in opposite directions and powering the sun drive gear causes the spools to rotate in the same direction.

19 Claims, 6 Drawing Sheets

MULTIFUNCTIONAL WINCH DRUM DRIVE SYSTEM

BACKGROUND OF THE INVENTION

1. Field of the Invention.

This invention relates to the field of winches. More specifically the present invention comprises a winch drum drive system for selectively operating multiple winch drums.

2. Description of the Related Art

Although winch drum drive systems have utilities in many fields, winch drum drive systems are particularly useful in the field of kite sailing where kites are used to power watercraft. Kite sailing involves the use of traction kites to harness wind energy for propulsion power. The towing kite is held within a stream of moving air, creating a pressure differential that causes the vessel to move.

Kites provide several unique advantages over traditional sails. One advantage is increased stability. Traditional sail boats experience a heeling moment which causes the vessel to tilt. When equipped with a traction kite, the force a ship experience has an upward and lateral component. The upward component, called the lifting force, generates a righting moment. This moment counteracts the heeling moment cause by the lateral component of the force, thereby providing a higher degree of stability. Traction kites also offer an advantage of increased speed. Kites can be raised to higher altitudes than traditional sails. Under most conditions, the wind speed increases with increasing altitude. Accordingly, kites can be used to harness wind energy at various altitudes to achieve optimum speeds.

Although the use of kites to power watercraft is a well-known idea, several limitations have prevented widespread acceptance. Control of a kite requires the use of multiple control lines. For small recreational watercraft, a single user can typically manage the control of the kite manually. Larger watercraft require larger kites, and larger kites can be complex to control. One reason for this is that bigger kites supply more tension on the control lines. It is therefore desirable to provide a control system suitable for controlling large kites with multiple control lines. The winch described herein was developed to provide this control; however, the reader should understand that the winch described herein has many other applications.

BRIEF SUMMARY OF THE INVENTION

The present invention comprises a winch drum drive system. The winch drum drive system includes spools for winding and unwinding lines and a set of planetary gears rotatably attached to one end of each of the spools. The winch drum drive system is configured to be operable in two states. In the first state, the spools rotate in the same direction. In the second state, the spools rotate in opposite directions. Each state can further be operated in forward mode or reverse mode. Accordingly, in a two-spool system, the user can either rotate both spools clockwise, both spools counterclockwise, or rotate one spool clockwise while the other rotates counterclockwise. This feature provides a user with full control over the rotation of all spools, and the lines attached thereto, using a single gearbox.

In the preferred embodiment, a ring gear wraps around each set of planetary gears so that the internal perimeter of the ring gear is meshed with each of the planetary gears in the set. The ring gear includes a set of external teeth so that it may be meshed with a second ring gear corresponding to a different spool. A ring drive gear is meshed with one of the ring gears, so that when power is sent to the ring drive gear the ring gears rotate in different directions. A sun gear is positioned between and meshed with each set of planetary gears. A sun drive gear is placed between and meshed with the sun gears so that when power is sent to the sun drive gear, the sun gears rotate in the same direction. Using the proposed configuration, powering the ring drive gear causes the spools to rotate in opposite directions and powering the sun drive gear causes the spools to rotate in the same direction.

REFERENCE NUMERALS IN THE DRAWINGS

| | |
|---|---|
| 10 winch drum drive system | 12 sun drive gear |
| 14 ring drive gear | 16 spool |
| 18 line | 20 sun gear |
| 22 ring gear | 24 planetary gear |
| 26 planetary axle | 28 sun gear planetary teeth |
| 30 planetary gear teeth | 32 internal teeth |
| 34 external teeth | 36 sun gear drive teeth |
| 38 shaft | 40 teeth |
| 42 motor | 44 motor |
| 46 input shaft | 48 input shaft |
| 50 output shaft | 52 output shaft |
| 54 dog clutch | 56 dog clutch |
| 58 shift fork | 60 actuation solenoid |
| 62 gear | 64 gear |
| 66 gear | 68 gear |
| 70 gear | 72 gear |
| 74 reverse idler | 76 gear |
| 78 gear | 80 reverse idler |
| 82 dog clutch | 84 dog clutch |
| 86 lay shaft | 88 lay shaft |
| 90 line | 92 spool |

DETAILED DESCRIPTION OF THE INVENTION

Figure 1:
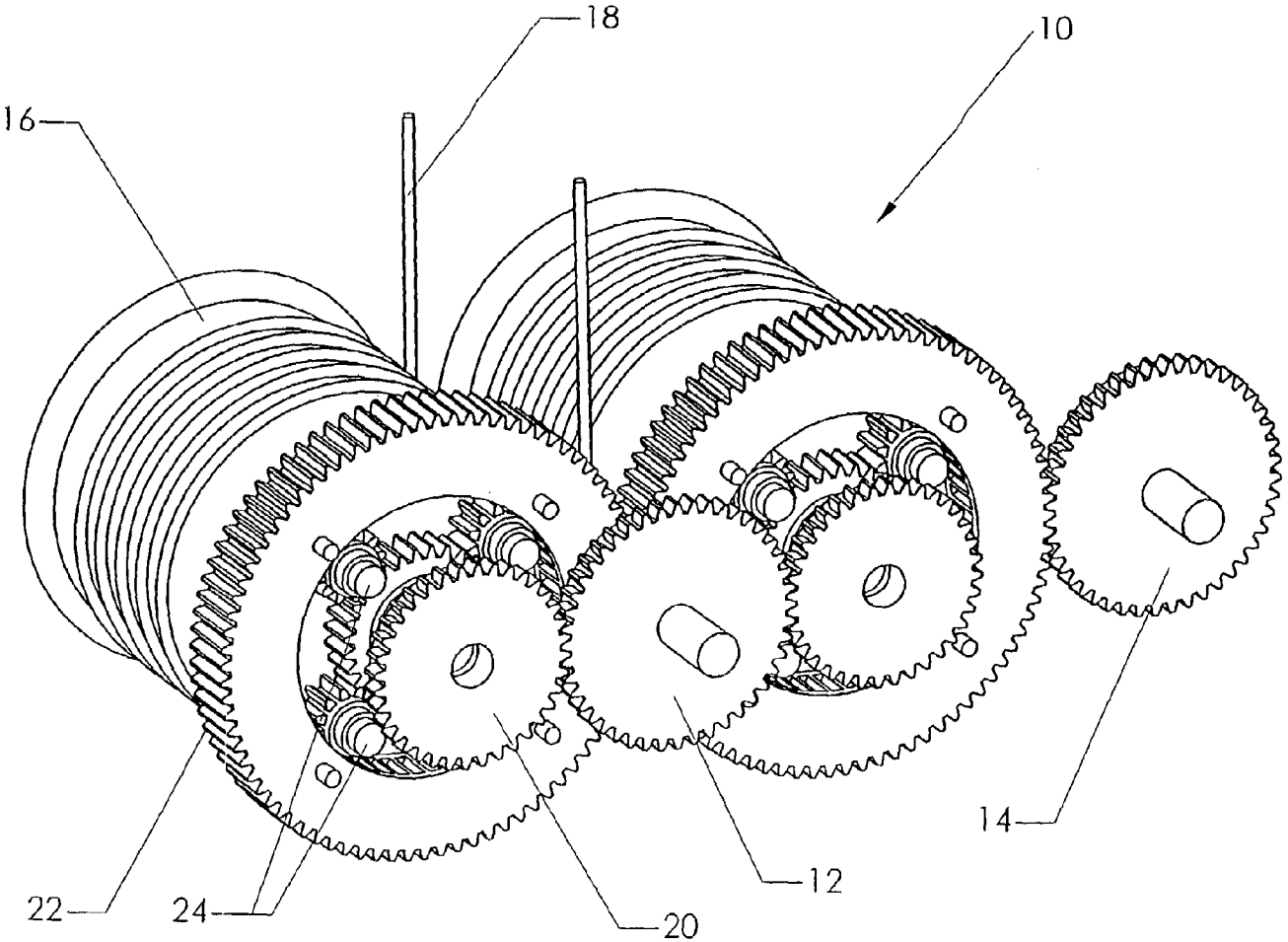
FIG. 1 is a perspective view, showing all components of the present invention.

The present invention, winch drum drive system 10, is illustrated in FIG. 1. Although the following description considers the use of winch drum drive system 10 for kite control, kite control is used as an example only. Winch drum drive system 10 may also be used in other applications, such as on a boom crane.

The winch drum drive system includes multiple spools for winding an unwinding kite control or other types of lines. The number of spools that are used depends upon the specifications of the kite and the required amount of control lines needed to control the kite. For illustrative purposes, a basic two-line kite is considered. The present invention could also be applied to kites with more than two control lines by adding more of the same gear modules.

In the preferred embodiment, lines 18 are wrapped in opposite directions around spools 16. Each spool 16 has a first end, a second end, and a winding drum in between for winding and unwinding line 18. Planetary gears 24 are rotatably attached to the first end of spool 16. Each planetary gear 24 rotates about an axle which is attached to the first end of the spool. Each planetary gear 24 is radially displaced from the center of the spool. Although four planetary gears 24 are shown attached to each spool 16, a different number of planetary gears 24 may also be used. Ring gear 22 has a first set of teeth around its outer perimeter and a second set of teeth set within its inner perimeter. Planetary gears 24 are set within the inside perimeter of ring gear 22 so that the perimeter of planetary gears 24 and the inside perimeter of ring gear 22 are in mesh.

Sun gear 20 is placed between planetary gears 24 near the center of spool 16. A detailed illustration of sun gear 20 is provided in FIG. 5. Sun gear 20 may be a single deep gear or two gears locked on a common axle. In both the single gear and two gear embodiments, sun gear 20 has two ends. At one end, the perimeter of sun gear 20 is in mesh with planetary gears 24, via sun gear planetary teeth 28. At the other end of sun gear 20, sun gear 20 is meshed with sun drive 12, via sun gear drive teeth 36. Sun drive gear 12 has teeth 40 around its perimeter which mesh with sun gear drive teeth 36. Power is transmitted to sun drive gear 12 through shaft 38. In the embodiment of sun gear 20 depicted in FIG. 5, sun gear 20 has two separate sets of teeth—one set corresponding to each end of sun gear 20. The reader will note that the same result can be accomplished using a single set of teeth. For example, sun gear 20 may be a deep gear with teeth extending across the entirety of its depth—from the first end to the second end. In this example, a portion proximal the first end engage the planetary gears, and a portion proximal the second end engage the sun drive gear.

Figure 5:
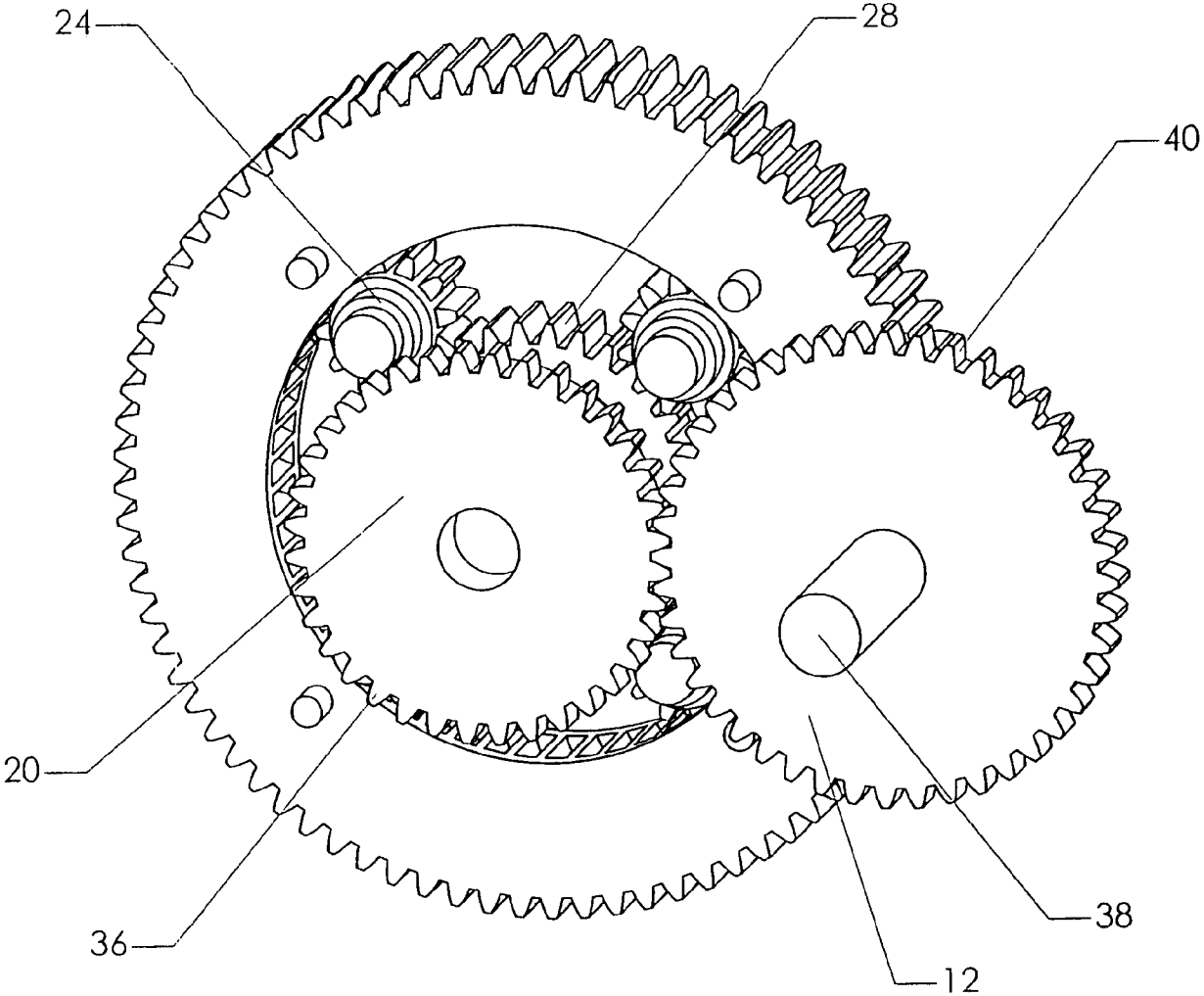
FIG. 5 is a perspective view, showing details of a sun gear.

The aforementioned components of FIG. 5 make up a basic gear module that may be used in various configurations. In the basic two-line application, a second gear module is placed alongside the first module so that each ring gear 22 is in mesh as shown in FIG. 1. Sun drive gear 12 is placed between sun gears 20 so that when sun drive gear 12 is powered, sun gears 20 rotate in the same direction. Ring drive gear 14 is placed in mesh with one ring gear 22 so that when ring drive gear 14 is powered, ring gears 22 rotate in opposite directions. Sun drive gear 12 and ring drive gear 14 may be alternately powered so that the same gear modules may be used for two different states—a sun-driven state and a ring-driven state. These states will be described in greater detail subsequently.

The configuration can be expanded to support even more control lines and spools. For example, a third module can be placed adjacent to either of the other two modules so that its ring gear 22 is meshed with one of the other ring gears. Another gear may be placed between the two sun gears 20 similar to sun drive gear 12. Even more gear modules can be added this way.

Figure 2:
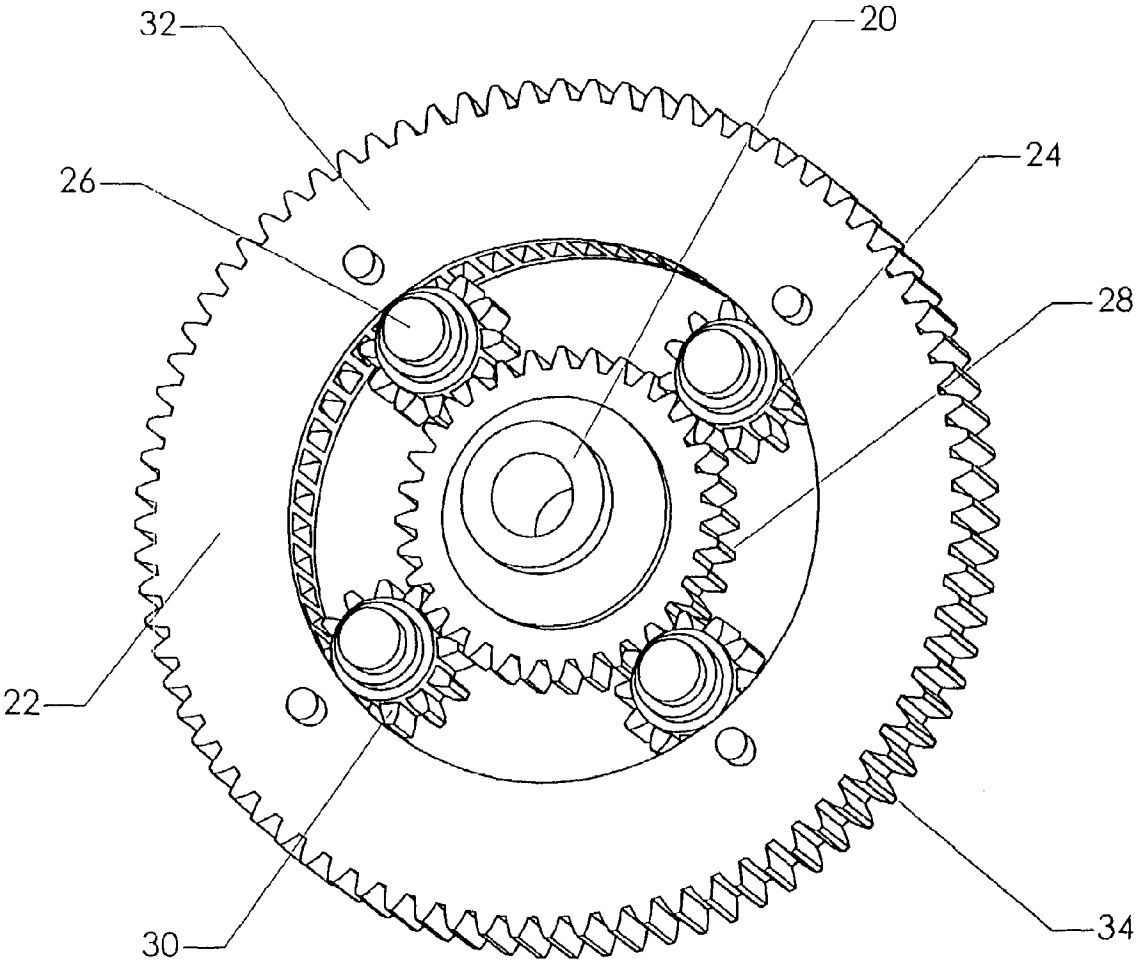
FIG. 2 is a perspective view, showing details of a planetary gear set.

A detailed view of one gear module is provided in FIG. 2. The reader will note that ring gear 22 has an internal perimeter and an external perimeter. External teeth 34 are provided along the external perimeter so that it may be linked with other ring gears or a ring drive gear. Internal teeth 32 are also provided along the internal perimeter of ring gear 22 to mesh with planetary gear teeth 30 of planetary gear 24. Planetary gears 24 are mounted on axles which are attached to the end of the spool. This feature allows them to rotate independently of the spool. Planetary axle 26 are provided to permit the independent rotation of planetary gear 24. The reader will note that planetary axle 26 also causes the spool to turn as planetary gears 24 travel along the inside perimeter of ring gear 22. Sun gear 20 has sun gear planetary teeth 28 near one end which mesh with planetary gear teeth 30.

Figure 3:
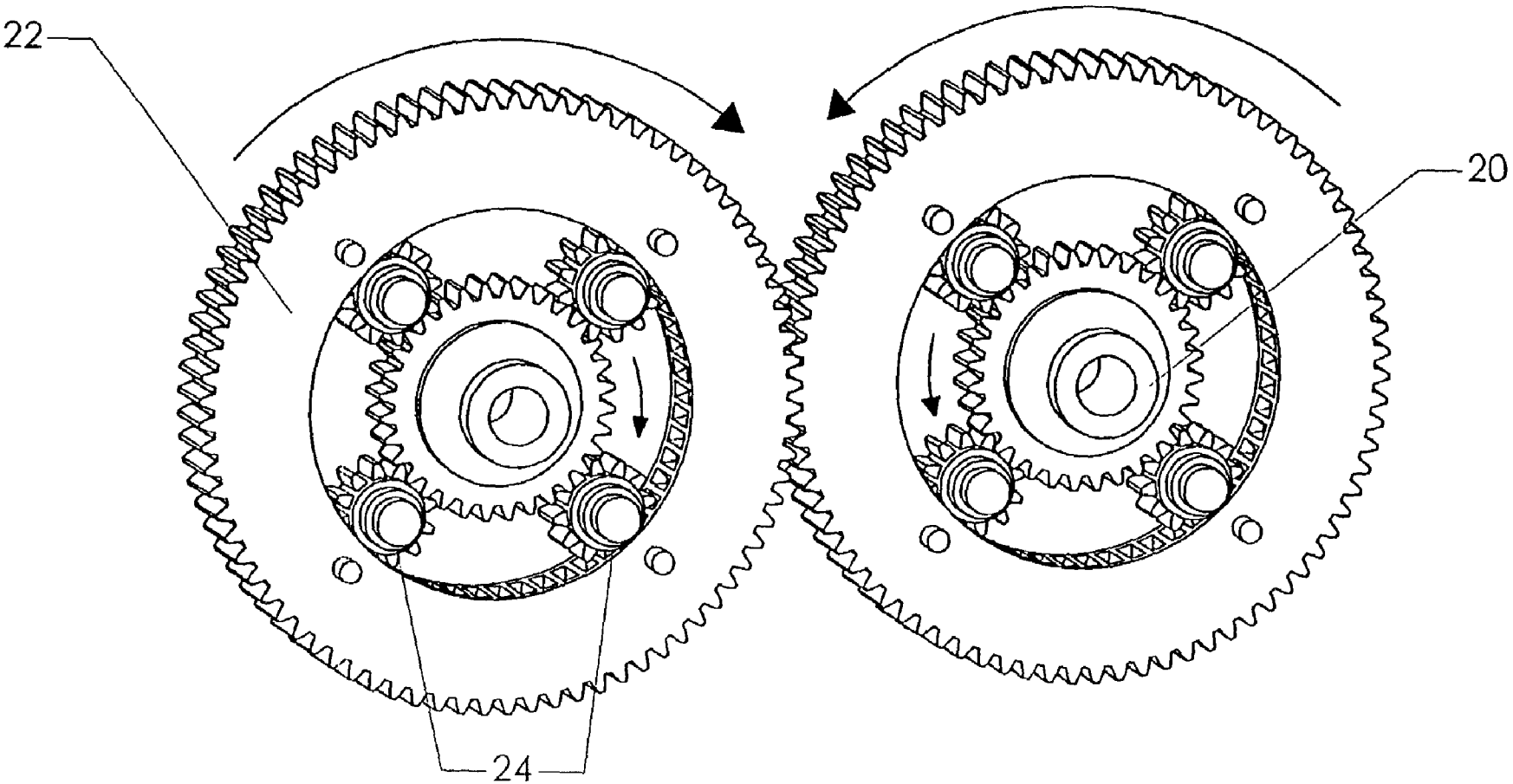
FIG. 3 is a perspective view, showing counter-rotating operation.
Figure 4:
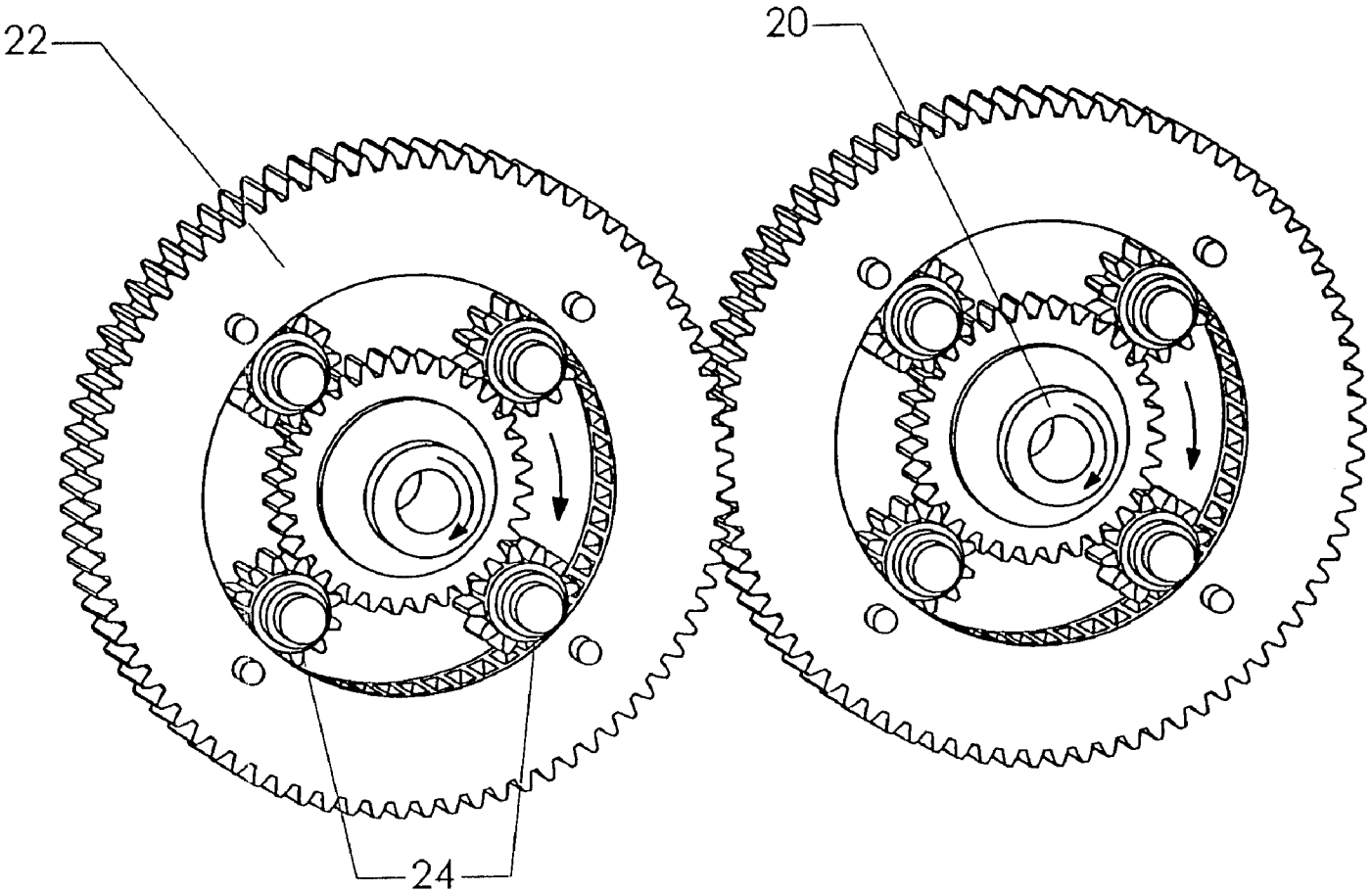
FIG. 4 is a perspective view, showing concurring-rotating operation.

The operation of the present invention is illustrated in FIGS. 3 and 4. FIG. 3 illustrates operation of the gear modules in the ring-driven state when ring drive gear 14 is powered and sun drive gear 12 is held stationary. When sun drive gear 12 is stationary sun gears 20 are locked in place. Powering ring drive gear 14 causes ring gears 22 to rotate in opposite directions as illustrated by the arrows. Because sun gears 20 are stationary, planetary gears 24 travel around the sun gear in the same direction as ring gear 22 although at a slower rate. Accordingly, the spools turn the same direction as ring gears 22 as indicated by the arrows in FIG. 3. In the preferred embodiment, the control lines are wrapped around the spool in different directions (see FIG. 1). Thus, powering ring drive gear 14 causes the spools to simultaneously wind in or wind out (depending upon direction) the control lines.

FIG. 4 illustrates operation of the gear modules in the sun-driven state when sun drive gear 12 is powered and ring drive gear 14 is held stationary. Holding ring drive gear 14 stationary locks both ring gears 22 in place. Powering sun drive gear 12 causes sun gears 20 to rotate angularly in the same direction. Because ring gears 22 are held stationary, planetary gears 24 travel around ring gears 22 in the same angular direction as the rotation of sun gears 20 as indicated by the arrows in FIG. 4. The two drums therefore rotate in the same direction. Thus, powering sun drive gear 12 causes one spool to let out the control line and one spool to wind in the control line.

At this point the reader will appreciate that the proposed winch drum drive system gives the user the ability to have full control of the two spools. The user can pull both lines in to empower the kite, let both lines out to depower the kite, or pull one line in while letting one line out to change the direction of the kite. For greater convenience, winch drum drive system may be controlled by a simple joystick. For example, pulling left on the joy stick may cause the controller to power sun drive gear 12 in a direction that will pull in the left control line and let out the right control line. Pulling right on the joy stick causes sun drive gear 12 to rotate the opposite direction. Pulling back on the joystick causes ring drive gear 14 to turn in a direction that will cause both control lines to be pulled in. Pushing forward on the joystick causes ring drive gear 14 to turn the opposite direction and let the lines out. These directions may be reversed or other suitable control mechanisms may be provided other than a joystick.

Figure 6:
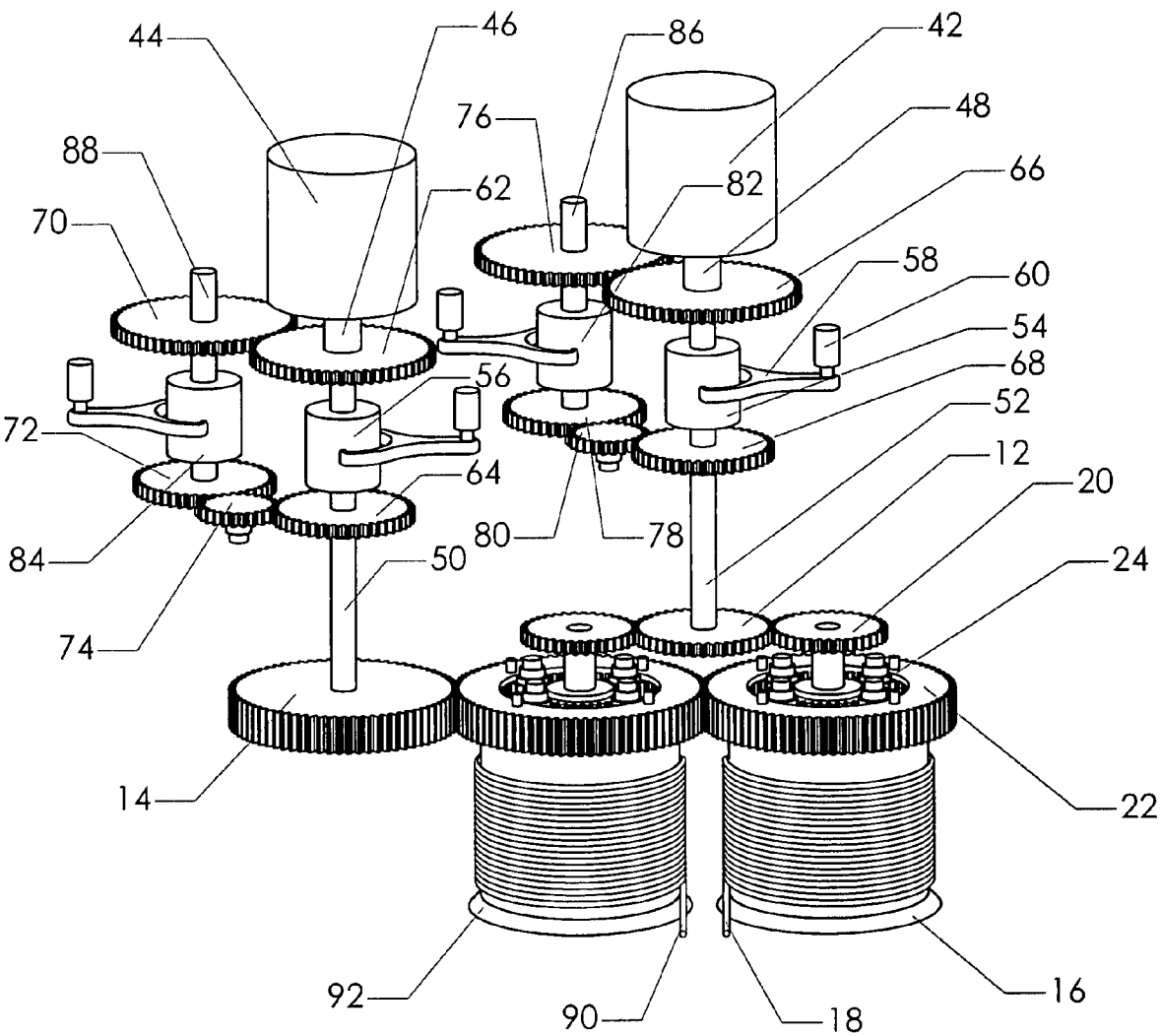
FIG. 6 is a perspective view, showing a power and transmission system for the present invention.

In addition various brakes or clutches may be used to power the desired drive gear while holding the other stationary. An example power and transmission system which may be employed in combination with winch drum drive system 10 is illustrated in FIG. 6. In this embodiment 2 motors, motor 42 and motor 44, are used to power winch drum drive system 10. Motor 44 is used to power ring drive gear 14 and motor 42 is used to power sun drive gear 12.

Dog clutch 54 and dog clutch 82 are used to control the direction of angular rotation of sun drive gear 12. In the illustrated embodiment, the direction of angular rotation of sun drive gear 12 determines whether line 18 is pulled in or let out of spool 16. When sun drive gear 12 is powered, line 90 and spool 92 behave oppositely of line 18 and spool 16. For example, if line 18 is pulled into spool 16, then line 90 will be let out of spool 92. Motor 42 supplies power to input shaft 48. Gear 66 rotates with input shaft 48. Dog clutch 54 selectively engages or disengages output shaft 52 from input shaft 48. Accordingly, when dog clutch 54 links output shaft 52 and input shaft 48, both shafts rotate the same direction and sun drive gear 12 rotates in the same direction as motor 42. The transmission of power directly from input shaft 48 to output shaft 52 defines a first state.

A second state is created by the disengagement of output shaft 52 from input shaft 48 and the engagement of gear 76 and gear 78 by dog clutch 82. In this state, power is transmitted from motor 42 to gear 66 to gear 76. Gear 76 is attached to lay shaft 86 so that rotation of gear 76 causes lay shaft 86 to rotate. When dog clutch 82 links the two sides of lay shaft 86, power is transmitted to gear 78 from lay shaft 86. From gear 78, power is transmitted to reverse idler 80 and on to gear 68 and output shaft 52. Accordingly, when dog clutch 82 is engaged and dog clutch 54 is disengaged, output shaft 52 rotates in an opposite direction of input shaft 48. As mentioned previously, when dog clutch 82 is disengaged and dog clutch 54 is engaged, output shaft 52 rotates in the same direction as input shaft 48.

Corresponding third and fourth states can be created using motor 44 and its associated transmission system. The transmission system for motor 44 works in the same manner as the transmission system for motor 42. When dog clutch 56 is engaged, motor 44 supplies power to input shaft 46 directly through output shaft 50 and ring drive gear 14. This defines the third state. In this state, ring drive gear 14 rotates in the same direction as motor 44.

A fourth state is created by the disengagement of output shaft 50 from input shaft 46 and the engagement of gear 70 and gear 72 by dog clutch 84. In this state, power is transmitted from motor 44 to gear 62 to gear 70. Gear 70 is attached to lay shaft 88 so that rotation of gear 70 causes lay shaft 88 to rotate. When dog clutch 84 links the two sides of lay shaft 88, power is transmitted to gear 72 from lay shaft 88. From gear 72, power is transmitted to reverse idler 74 and on to gear 64 and output shaft 50. Accordingly, when dog clutch 84 is engaged and dog clutch 56 is disengaged, output shaft 50 rotates in an opposite direction of input shaft 46. As mentioned previously, when dog clutch 84 is disengaged and dog clutch 56 is engaged, output shaft 50 rotates in the same direction as input shaft 46

The reader will appreciate that when sun drive gear 12 is powered, either dog clutch 82 or dog clutch 54 is engaged, while dog clutch 84 and dog clutch 56 are both disengaged. When ring drive gear 14 is powered, either dog clutch 84 or dog clutch 56 is engaged, while both dog clutch 82 and dog clutch 54 are disengaged. It should be noted that when changing states, all dog clutches should be temporarily disengaged before the appropriate dog clutch is engaged. In addition, other components may be incorporated to lock the sun gear or the ring gear in place.

Although a two motor system is illustrated in FIG. 6, the system could easily be modified to work with one motor. For example, the single motor could turn one gear which is in mesh with both gear 66 and gear 62, thereby causing gear 66 and gear 62 to rotate in the same direction. Accordingly, only one motor is required for full control over both spools.

The reader will now appreciate how the aforementioned joystick system may be used to control the kite control lines. The joystick is used to control the transmission system state by using dog clutches 54, 82, 56, and 84 to control the flow of power. The dog clutches can be controlled by electrical or mechanical actuators. As shown in FIG. 6, Actuation solenoid 60 may be employed to control to move shift fork 50. Shift fork 50 couples or decouples input shaft 48 and output shaft 52 depending upon its position. Accordingly, actuation solenoid 60 may be electronically controlled by the joystick.

It should also be noted that the power and transmission system illustrated in FIG. 6, may be substantially replaced by two reversible motors, such as electric or hydraulic motors. In this scenario, one reversible motor may supply power directly to sun drive gear 12 and a second reversible motor may supply power directly to ring drive gear 14 (each transmitting power to the respective drive gear without the use of dog clutches or transmission gears). Winch drum drive system 10 is well-suited for pairing with the aforementioned reversible motors. When operating in the ring-driven state (i.e., when using the kite to turn), one line is being let out and one line is being pulled in at the same rate. Because of the mechanical advantage of the ring gears, the power required to operate this state is relatively low compared to the tension on either of the control lines.

Various other components may be employed with the present invention to improve performance and functionality. For example, worm gears or brakes may be integrated between the power system and winch drum drive system 10 to prevent the spools from unwinding when the motors are at rest. In addition, various safety subsystems may be employed to account for wind gusts and tension spikes on the control lines. As an example, a torque limiting friction clutch may be integrated with the spool. The torque limiting friction clutch may be configured to allow the spool to spin freely when the torque generated by control line tension exceeds the torque at which the clutch is set.

The preceding description contains significant detail regarding the novel aspects of the present invention. It should not be construed, however, as limiting the scope of the invention but rather as providing illustrations of the preferred embodiments of the invention. As an example, different quantities of planetary gears 24 or gear modules may be provided in various configurations. Also, many different motor and transmission system configurations can be used in place of the illustrated dog clutch transmission.

In addition, the preceding description illustrates one mechanism that may be used to accomplish the objectives of the present invention. The present invention comprises a winch drum drive system configured to operate in a first state and a second state. When operating in the first state, the lines are either simultaneously let out or simultaneously drawn in. When operating in the second state, one line is let out while the other line is drawn in. Other gearing combinations may be used to create these first and second states. The aforementioned variations would not alter the function of the invention. Thus, the scope of the invention should be fixed by the following claims, rather than by the examples given.

Having described my invention, I claim:

1. A winch drum drive system for controlling a first control line and a second control line comprising:

a. a first spool configured to wind and unwind said first control line, said first spool having a first end, a second end, and a winding surface therebetween, said first end having a center and a perimeter;

b. a second spool configured to wind and unwind said second control line, said second spool having a first end, a second end, and a winding surface therebetween, said first end having a center and a perimeter;

c. a first plurality of planetary gears wherein each planetary gear has an axle and each axle is attached to said first end of said first spool, each of said first plurality of planetary gears radially displaced from said center of said first end of said first spool;

d. a second plurality of planetary gears wherein each planetary gear has an axle and each axle is attached to said first end of said second spool, each of said second plurality of planetary gears radially displaced from said center of said first end of said second spool;

e. a first ring gear wrapping around said first plurality of planetary gears, said first ring gear having an inside perimeter and an outside perimeter, said inside perimeter meshed with said first plurality of planetary gears;

f. a second ring gear wrapping around said second plurality of planetary gears, said second ring gear having an inside perimeter and an outside perimeter, said inside perimeter meshed with said second plurality of planetary gears, said outside perimeter meshed with said outside perimeter of said first ring gear;

g. a first sun gear positioned proximal said center of said first side of said first spool and within said first plurality of planetary gears, said first sun gear having a first end, a second end, and a perimeter surface therebetween; said perimeter surface meshed with said first plurality of planetary gears; and h. a second sun gear positioned proximal said center of said first side of said second spool and within said second plurality of planetary gears, said second sun gear having a first end, a second end, and a perimeter surface therebetween, said perimeter surface meshed with said second plurality of planetary gears.

2. The winch drum drive system of claim 1, further comprising a sun drive gear positioned between said first sun gear and said second sun gear, said sun drive gear meshed with said first sun gear and second sun gear and configured to drive said first sun gear and said second sun gear.

3. The winch drum drive system of claim 2, further comprising a ring drive gear positioned proximal said first ring gear, said ring drive gear meshed with said first ring gear.

4. The winch drum drive system of claim 3, wherein said winch drum drive system is configured to be operable in a first state and a second state; wherein during operation in said first state, said ring drive gear is powered and said first spool and said second spool rotate in opposite directions; and wherein during operation in said second state, said sun drive gear is powered and said first spool and said second spool rotate in the same direction.

5. The winch drum drive system of claim 4, wherein said first control line and second control line are operatively attached to a kite.

6. The winch drum drive system of claim 1, further comprising a ring drive gear positioned proximal said first ring gear, said ring drive gear meshed with said first ring gear.

7. The winch drum drive system of claim 1, wherein said first plurality of planetary gears includes two planetary gears.

8. The winch drum drive system of claim 7, wherein said first plurality of planetary gears includes three planetary gears.

9. The winch drum drive system of claim 8, wherein said first plurality of planetary gears includes four planetary gears.

10. The winch drum drive system of claim 1, wherein said winch drum drive system is configured to be operable in a first state and a second state; wherein during operation in said first state, said first ring gear is powered and said first spool and said second spool rotate in opposite directions; and wherein during operation in said second state, said first sun gear and said second sun gear are together powered and said first spool and said second spool rotate in the same direction.

11. The winch drum drive system of claim 10, wherein said first control line and second control line are operatively attached to a kite.

12. The winch drum drive system of claim 1, wherein said first control line and second control line are operatively attached to a kite.

13. A winch drum drive system for controlling a first control line and a second control line comprising:

a. a first spool configured to wind and unwind said first control line, said first spool having a first end, a second end, and a winding surface therebetween, said first end having a center and a perimeter;

b. a second spool configured to wind and unwind said second control line, said second spool having a first end, a second end, and a winding surface therebetween, said first end having a center and a perimeter;

c. a first plurality of planetary gears wherein each planetary gear has an axle and each axle is attached to said first end of said first spool, each of said first plurality of planetary gears radially displaced from said center of said first end of said first spool;

d. a second plurality of planetary gears wherein each planetary gear has an axle and each axle is attached to said first end of said second spool, each of said second plurality of planetary gears radially displaced from said center of said first end of said second spool; and e. wherein said winch drum drive system is configured to be operable in a first state and a second state; wherein during operation in said first state, said first spool and said second spool rotate in opposite directions; and wherein during operation in said second state, said first spool and said second spool rotate in the same direction.

14. The winch drum drive system of claim 13, further comprising:

a. a first ring gear wrapping around said first plurality of planetary gears, said first ring gear having an inside perimeter and an outside perimeter, said inside perimeter meshed with said first plurality of planetary gears; and b. a second ring gear wrapping around said second plurality of planetary gears, said second ring gear having an inside perimeter and an outside perimeter, said inside perimeter meshed with said second plurality of planetary gears, said outside perimeter meshed with said outside perimeter of said first ring gear.

15. The winch drum drive system of claim 14, further comprising a ring drive gear positioned proximal said first ring gear, said ring drive gear meshed with said first ring gear.

16. The winch drum drive system of claim 14, wherein during operation in said first state, said first ring gear is powered, causing said first spool and said second spool rotate in opposite directions.

17. The winch drum drive system of claim 13, further comprising:

a. a first sun gear positioned proximal said center of said first side of said first spool and within said first plurality of planetary gears, said first sun gear having a first end, a second end, and a perimeter surface therebetween; said perimeter surface meshed with said first plurality of planetary gears; and b. a second sun gear positioned proximal said center of said first side of said second spool and within said second plurality of planetary gears, said second sun gear having a first end, a second end, and a perimeter surface therebetween, said perimeter surface meshed with said second plurality of planetary gears.

18. The winch drum drive system of claim 17, further comprising a sun drive gear positioned between said first sun gear and said second sun gear, said sun drive gear meshed with said first sun gear and second sun gear and configured to drive said first sun gear and said second sun gear.

19. The winch drum drive system of claim 17, wherein during operation in said second state, said first sun gear and said second sun gear are together powered and said first spool and said second spool rotate in the same direction.

* * * * *